United States Patent [19]

Albrecht

[11] 4,217,630

[45] Aug. 12, 1980

[54] FLUORESCENT LAMP BASE ASSEMBLY

[75] Inventor: Wolfgang Albrecht, Berlin, Fed. Rep. of Germany

[73] Assignee: Patent-Treuhand-Gesellschaft für Elektrische Glühlampen mbH, Munich, Fed. Rep. of Germany

[21] Appl. No.: 857,657

[22] Filed: Dec. 5, 1977

[30] Foreign Application Priority Data

Dec. 28, 1976 [DE] Fed. Rep. of Germany ..... 2659167

[51] Int. Cl.[2] ..... F21S 3/00

[52] U.S. Cl. ..... 362/217; 339/144 R; 339/144 T; 339/145 R

[58] Field of Search ..... 362/217; 339/144 R, 339/144 T, 145 R; 313/318

[56] References Cited

U.S. PATENT DOCUMENTS

| | | | |
|---|---|---|---|
| 3,723,945 | 3/1973 | Detch | 362/217 |
| 3,753,027 | 8/1973 | Kolkman | 339/145 R |

*Primary Examiner*—Benjamin R. Padgett
*Assistant Examiner*—J. L. Barr
*Attorney, Agent, or Firm*—Frishauf, Holtz, Goodman & Woodward

[57] ABSTRACT

A U-shaped flourescent lamp base assembly and finished lamp. The base assembly comprises two contact-containing base caps which are interconnected by an elongated spacer member. Each cap has a pair of substantially parallel radially outwardly projecting members having extending means therebetween. The spacer member has respective ends slideably engagable between the said radially outwardly projecting members for positively engaging said extending means.

14 Claims, 5 Drawing Figures

FLUORESCENT LAMP BASE ASSEMBLY

BACKGROUND OF THE INVENTION

The present invention relates to an improved base assembly for a fluorescent lamp having a glass envelope of U-shape, comprising two bases provided with contact pins and an oblong spacer member.

In order to ensure the spacing of the two bases or of the two bent lamp ends, respectively, it is well known to provide each base with a metal clamp around its circumference in such manner that the flaps of the respective clamp point towards each other in the direction of the connection line of the two bases. The two clamps are then interconnected by means of a crossbar which is placed with its respective ends between the pair of clamp flaps and is riveted in this place (Elektronorm (1963), No. 2, page 59).

Another type of base assembly for U-shaped fluorescent lamps has been disclosed in U.S. Pat. No. 3,579,174. This structure provides a notch in the circumference of each base, the notches facing one another and extending in the plane common to the base pins. The notched bases are interconnected by a bar which has a groove at its ends. The grooved ends engage in the respective notch at the base circumference. The assembly is then sealed with cement to the lamp ends.

DT-OS No. 21 01 967 discloses a bracket with semicircularly or circularly curved ends as the spacer member; the straight-line portion of the bracket is passed through a notch in the circumference of the respective base cap which is flush with the base pins so that the curved ends of the bracket come to lie internally of the base cap. A ring-shaped binding agent (cement ring) is introduced into the base caps and the whole assembly is sealed to the lamp ends by heating.

It is the object of the present invention to minimize breakage of U-shaped lamps during fabrication by using an assembly which permits automation and is economical.

THE INVENTION

The present invention provides an improved base assembly for a U-shaped fluorescent lamp. The assembly comprises two bases connected by an elongated spacer member. Each base has a bottom and a cylindrical upwardly directed flange extending from said bottom. A pair of substantially parallel members project radially from each base toward the other. Each pair of projecting members has mutually facing surfaces. Means extend from at least one of said mutually facing surfaces toward the other adapted to engage a spacer member. The spacer member has respective ends slideably engagable between the mutually facing surfaces of the pairs of projecting members with notches close to its ends for positively engaging said respective extending means and thereby interconnecting the two bases. The spacer member is then fixed to the respectively outwardly projecting members, for example, by welding. The improved base assembly of the present invention, inexpensively, automatically, and accurately fixes the position of each base relative to the other so that it may be accurately and readily connected to the remainder of the lamp assembly.

In accordance with the preferred embodiment of the present invention, a generally U-shaped glass envelope comprises a base attached at the end of each end of the U- and an oblong spacer member connecting the two bases. Each base is designed as a cap having a bottom and a cylindrical upwardly extending flange. The flange has integral therewith radially outwardly projecting flaps positioned in the direction of the other base and in alignment with a similar pair of outwardly projecting flaps extending from the other base. Each of the outwardly projecting flaps has inwardly protruding lugs. The spacer member which is adapted to connect the two bases is an elongated member having notches provided toward its ends for engaging the respective lugs of the respective flanges, and thereby interconnecting the two bases.

Means are provided to compensate for deviations in the spacing between the two lamp ends in the direction of the connecting line between the two bases so long as the deviations are within the permissible limits (design clearances). The said means for compensating for deviations also provides ready engaging means for connecting the spacer and the base. Said means comprises a notch at the end of each of the elongated members. The notch is designed to extend from the outermost flange inwards, at first in a conically convergent manner and then diverging. The size of the notch after the enlargement begins and in the direction of the longitudinal axis of the spacer is larger than in the direction at right angles thereto and is also slightly larger than the diameter of the lug which the notch is adapted to engage, thereby permitting engagement by the oblong spacer member with bases spaced a distance apart within the design clearances. After the spacer member is engaged with the respective bases, it is fixed to the respective flaps, for example, by ultrasonic welding.

The base material, particularly the flaps, and the spacer member, are preferably made of a polyamide plastic.

The accompanying drawing illustrates an embodiment of the invention.

FIG. 1*a* is a bottom view of the base cap;

FIG. 1*b* is a partial sectional view through the center line of the base cap of FIG. 1*a;*

Figure 1A:
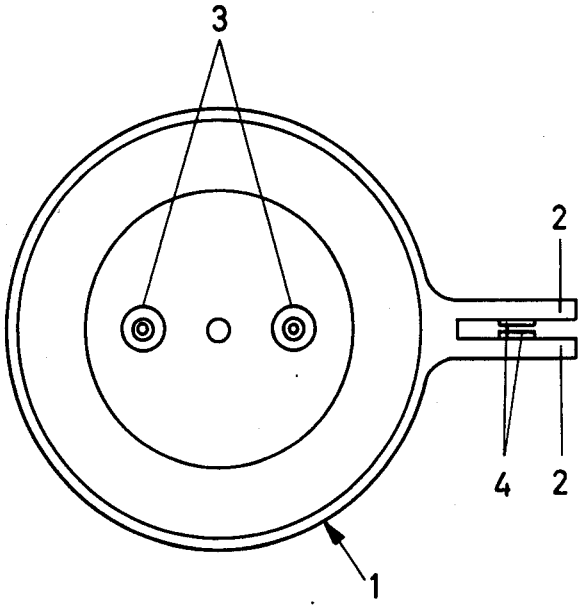
Figure 1B:
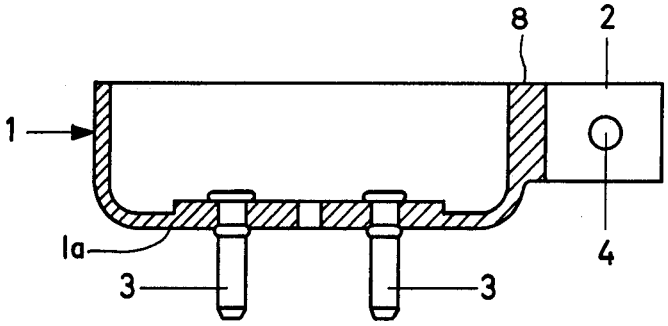
Figure 2:
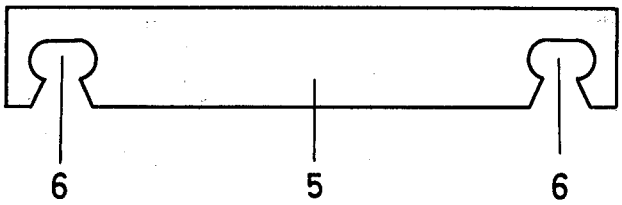
FIG. 2 is a plan view of the oblong spacer.

Each base cap 1 has a bottom 1*a* and upwardly extending flanges 8 which terminate in respective laterally projecting flaps 2. Two contact pins 3 are riveted to respective bases 1. Two lugs 4 are provided between the opposed flaps 2 facing each other.

The oblong spacer 5 has a notch 6 at each end adapted to engage the respective lugs 4 of respective flaps 2. The spacer member 5 engages the lugs 4 and interconnects the respective bases after the cementing of the bases to the lamp ends, i.e. one base at each end of the U-shaped lamp. Then the spacer 5 is fixed to the respective flaps 2, preferably at the notches 6 by, for example, welding or using an adhesive. This is preferably carried out before the cement connecting the lamp ends and bases has cured.

Figure 3:
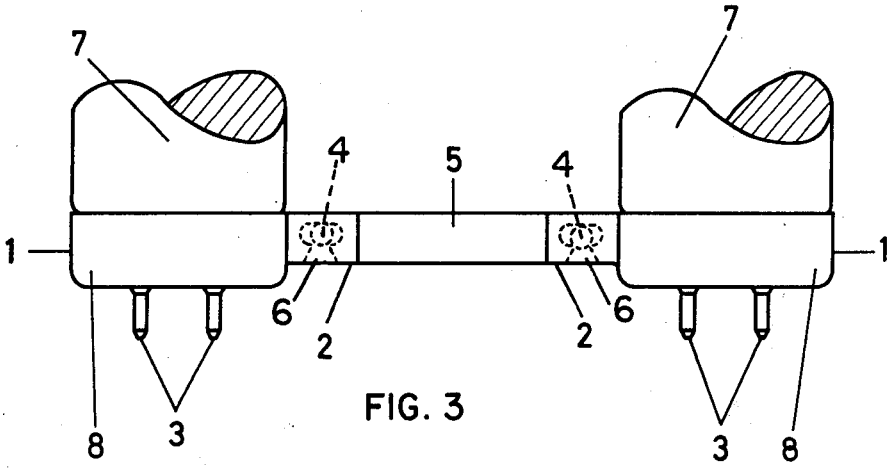
FIG. 3 is a side view of the base assembly wherein the two bases are connected by the oblong spacer.
Figure 4:
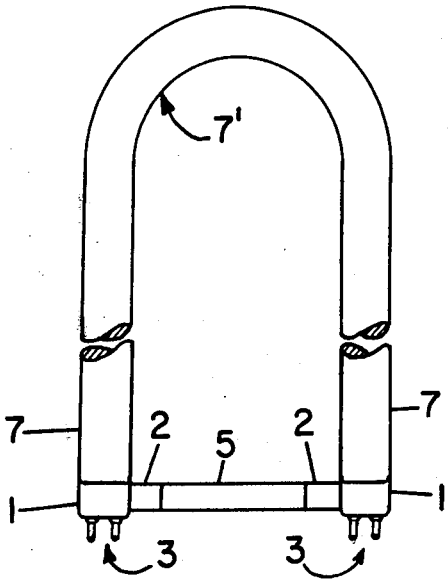
FIG. 4 is a schematic side view of the lamp with the spacer connected thereto.

FIG. 3 illustrates the finished base assembly wherein the respective bases 1 are cemented to the ends 7 of the lamp 7'.

The assembly of the present invention has the decided advantage in that the cost of materials are reduced by about 50%. There is an additional economy because the mounting operation of the spacer is simple and can be automated. A further advantage results from the flaps extending flush with the base end of the pins, thereby facilitating the connection of the base ends to the respective lamp ends.

During joining of the bases and respective lamp ends during manufacture, the flaps 2 are fixed in position in a recess of a mounting support (e.g., a jig) for the base. Distortion resulting in displacement of the bases during curing of the cement with consequent displacement of the pins is thus avoided. The fabrication of the base assembly of the present invention does not require modification of conventional manufacturing techniques since the engagement of the connecting spacer does not occur before the connection of the base ends to the lamp ends has been completed.

Various changes and modifications may be made within the scope of the inventive concept.

I claim:

1. In a U-shaped fluorescent lamp having a U-shaped envelope (7') including a pair of essentially parallel leg portions, a base assembly, comprising two bases (1, 1), each being connectable to a respective end (7) of said envelope (7'), each base having a bottom (1*a*), a cylindrical, upwardly directed flange (8) extending from said bottom, and contact means (3);

a pair of substantially parallel, radially outwardly projecting members (2, 2) laterally extending from each of said bases, each pair of projecting members having mutually facing surfaces, the pairs of projecting members extending toward each other from the respective bases;

means (4) extending from at least one of said mutually facing surfaces toward the other of said mutually facing surfaces of each pair of projecting members; and an elongated spacer member (5) having respective ends, slidably engageable between mutually facing surfaces of the pairs of projecting members, and being formed with notches (6) close to its ends for positively engaging said extending means (4) interconnecting the two bases (1, 1) together and positively spacing the bases (1, 1) on the envelope (7') of the U-shaped lamp from each other.

2. The base assembly of claim 1 wherein the notches (6) in the ends of said elongated spacer member each are formed for snappingly engaging said extending means (4).

3. The base assembly of claim 1 wherein said extending means comprises at least one lug (4) extending from at least one of said mutually facing surfaces.

4. The base assembly of claim 3 wherein the ends of said elongated spacer member each comprise means for snappingly engaging said at least one lug.

5. The base assembly of claim 1 wherein the extending means comprises means extending from each of said mutually facing surfaces of a pair of projecting members toward the other of said mutually facing surfaces.

6. The base assembly of claim 5 wherein each end of said elongated spacer member has a notch for engaging said extending means of a respective pair of projecting members.

7. The base assembly of claim 1 wherein said notches at the ends of the said elongated spacer member each comprise a conically convergent portion which extends inwardly from an outermost edge of the spacer member, and a divergent portion extending from the conically convergent portion.

8. The base assembly of claim 7 wherein said divergent portion comprises an enlarged area which is larger in the direction of the longitudinal axis of the elongated spacer member than in the direction at right angles thereto, the dimension in said longitudinal directional being larger than the dimension of said extending means in said direction of the longitudinal axis of the spacer member, thereby permitting adjustment of the relative positions of said bases and said elongated spacer member within design clearances.

9. The base assembly of claim 8 wherein said extending means comprises at least one lug extending from at least one of said mutually facing surfaces of a pair of projecting members.

10. The base assembly of claim 9 wherein said lug has a generally round cross-section, the diameter thereof being smaller than the dimension of the largest dimension of said divergent portion of said notch.

11. The base assembly of claim 9 wherein the smallest width of said convergent portion of said notch in the longitudinal direction of said elongated space member is smaller than the largest dimension of said lug in said longitudinal direction, whereby said smallest width portion of said convergent portion is snappable past said lug to engage said lug in said divergent portion of said notch.

12. The base assembly of claim 1 wherein each pair of said projecting members is integral with a respective base.

13. The base assembly of claim 1 wherein said contact means comprises a pair of base pins on each of said bases, and wherein said projecting members extend from their respective bases substantially flush with the base ends of said base pins.

14. The base assembly of claim 1 wherein said base assembly comprises a polyamide.

* * * * *